US010300322B2

(12) United States Patent
Graham

(10) Patent No.: US 10,300,322 B2
(45) **Date of Patent: *May 28, 2019**

(54) SHUTTLE TRAINING AND THERAPY DEVICE

(71) Applicant: Gary Graham, Bellingham, WA (US)

(72) Inventor: Gary Graham, Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/035,453

(22) Filed: Jul. 13, 2018

(65) Prior Publication Data

US 2018/0318632 A1 Nov. 8, 2018

Related U.S. Application Data

(63) Continuation of application No. 15/271,986, filed on Sep. 21, 2016, now Pat. No. 10,022,579.

(60) Provisional application No. 62/221,558, filed on Sep. 21, 2015.

(51) Int. Cl.

| | |
|---|---|
| ***A63B 21/00*** | (2006.01) |
| ***A63B 21/04*** | (2006.01) |
| ***A63B 22/00*** | (2006.01) |
| ***A63B 71/00*** | (2006.01) |
| ***A63B 21/055*** | (2006.01) |
| ***A63B 21/068*** | (2006.01) |

(52) U.S. Cl.

CPC ..... *A63B 21/0557* (2013.01); *A63B 21/0428* (2013.01); *A63B 21/068* (2013.01); *A63B 21/4033* (2015.10); *A63B 22/0087* (2013.01); *A63B 21/00061* (2013.01); *A63B 21/00065* (2013.01); *A63B 21/00069* (2013.01); *A63B 21/4034* (2015.10); *A63B 2071/0072* (2013.01); *A63B 2208/0247* (2013.01)

(58) Field of Classification Search

CPC ..... A63B 21/05; A63B 21/04; A63B 22/0087; A63B 22/0076; A63B 2022/0079; A63B 22/20

See application file for complete search history.

(56) References Cited

U.S. PATENT DOCUMENTS

| | | | | |
|---|---|---|---|---|
| 3,574,900 | A * | 4/1971 | Emery | B63B 21/08 114/218 |
| 6,383,122 | B1 * | 5/2002 | Graham | A63B 21/0552 482/121 |
| 7,606,953 | B2 * | 10/2009 | Ash | H04N 7/163 710/62 |
| 7,871,358 | B2 * | 1/2011 | Graham | A63B 21/055 482/122 |
| 9,108,079 | B2 * | 8/2015 | Solow | A63B 21/055 |
| 2006/0199712 | A1 * | 9/2006 | Barnard | A63B 22/0007 482/142 |

(Continued)

*Primary Examiner* — Garrett K Atkinson

(74) *Attorney, Agent, or Firm* — Schacht Law Office, Inc.; Dwayne Rogge

(57) ABSTRACT

A shuttle training and therapy device including in one example: a floor standing fame having a headward end and a footward end; a carriage slidably attached to the frame; a resistance system of elastic cords attached to the footward end of the frame; the elastic cords selectively attached to the carriage; and a range of motion limiting system comprising a control cord having a first end attached to the carriage, a second end selectively attached to the frame, and an intermediate portion attached to an elastic member attached to the carriage.

5 Claims, 4 Drawing Sheets

(56) References Cited

U.S. PATENT DOCUMENTS

| | | | | |
|---|---|---|---|---|
| 2007/0087921 | A1* | 4/2007 | Graham | A63B 21/055<br>482/132 |
| 2009/0118108 | A1* | 5/2009 | Uygan | A63B 21/154<br>482/135 |
| 2010/0216612 | A1* | 8/2010 | Graham | A63B 21/0552<br>482/121 |

* cited by examiner

SHUTTLE TRAINING AND THERAPY DEVICE

RELATED APPLICATIONS

This application claims priority of and is a continuation of U.S. application Ser. No. 15/271,986 filed on Sep. 21, 2016. U.S. application Ser. No. 15/271,986 filed on Sep. 21, 2016 claims priority of U.S. Application No. 62/221,558 filed on Sep. 21, 2015 and incorporated herein by reference.

BACKGROUND OF THE DISCLOSURE

Field of the Disclosure

This disclosure relates to an exercise and therapeutic apparatus and more specifically the configuration of elements in addition to a load resistance or range of motion limiting component.

The disclosure relates to the art of exercise apparatus that consists of a stationary frame, a horizontal moving carriage, a vertical kickplate, a resistance system, a rebound system, and an adjustable range of motion system. The exercising participant is positioned supine on a reciprocating moveable carriage with one or both feet positioned on a vertical kickplate. The participant self induces an oscillating or reciprocating motion in a longitudinal direction to the carriage against a variable resistance. The kickplate is normally attached to the foot end portion of the frame.

BRIEF SUMMARY OF THE DISCLOSURE

Disclosed herein is a shuttle training and therapy device comprising in one example: a floor standing fame having a headward end and a footward end; a carriage slidably attached to the frame; a resistance system of elastic cords attached to the footward end of the frame; the elastic cords selectively attached to the carriage; and a range of motion limiting system comprising a control cord having a first end attached to the carriage, a second end selectively attached to the frame, and an intermediate portion attached to an elastic member attached to the carriage.

DETAILED DESCRIPTION OF THE DISCLOSURE

Figure 1:
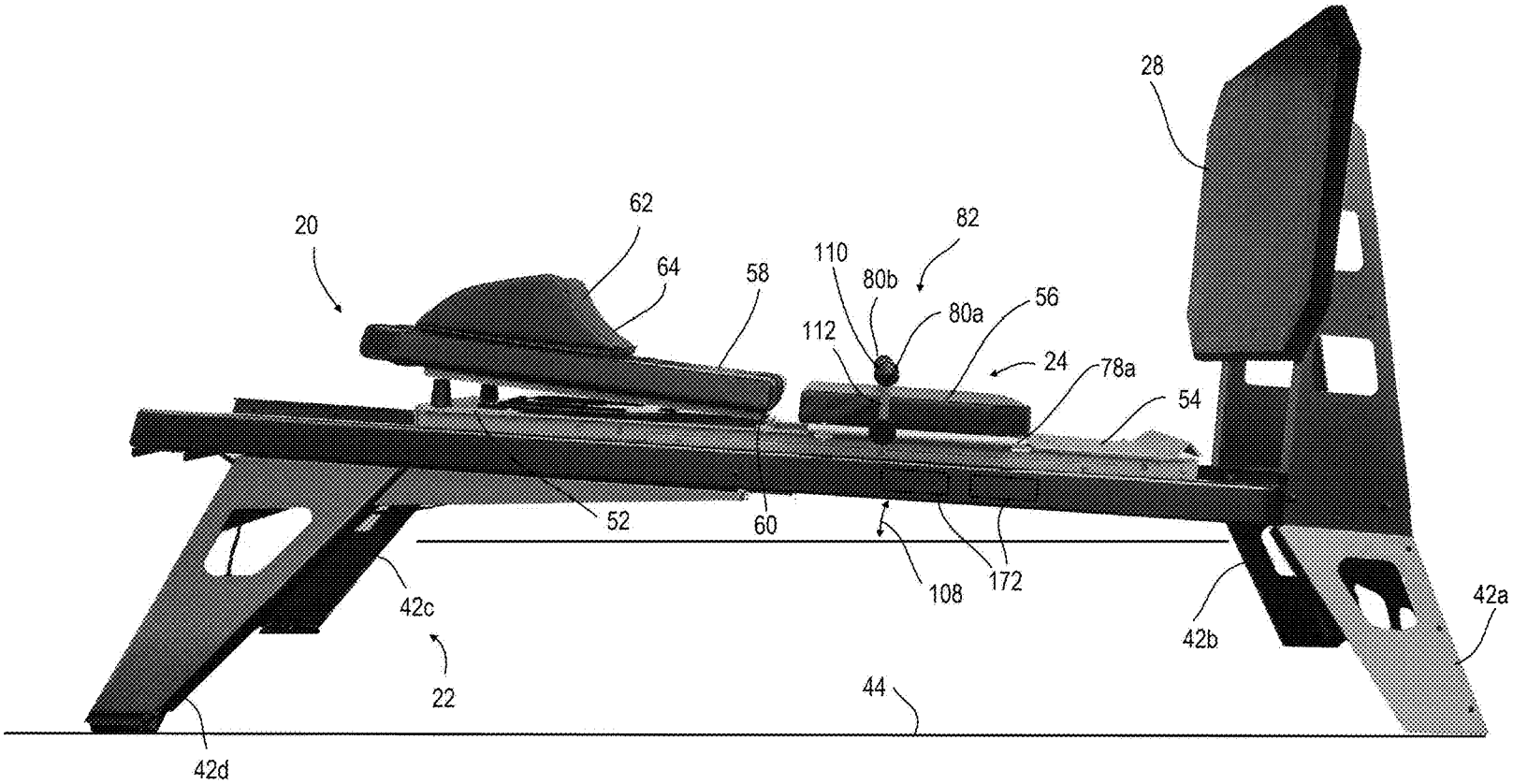
FIG. 1 is a greyscale side view of one example of the apparatus.

The shuttle training and therapy device 20 is comprised of a support frame 22, a longitudinally rolling/sliding carriage 24, a resistance system 26, a kick plate 28 and further in one form, a range of motion limiting system 30.

Figure 3:
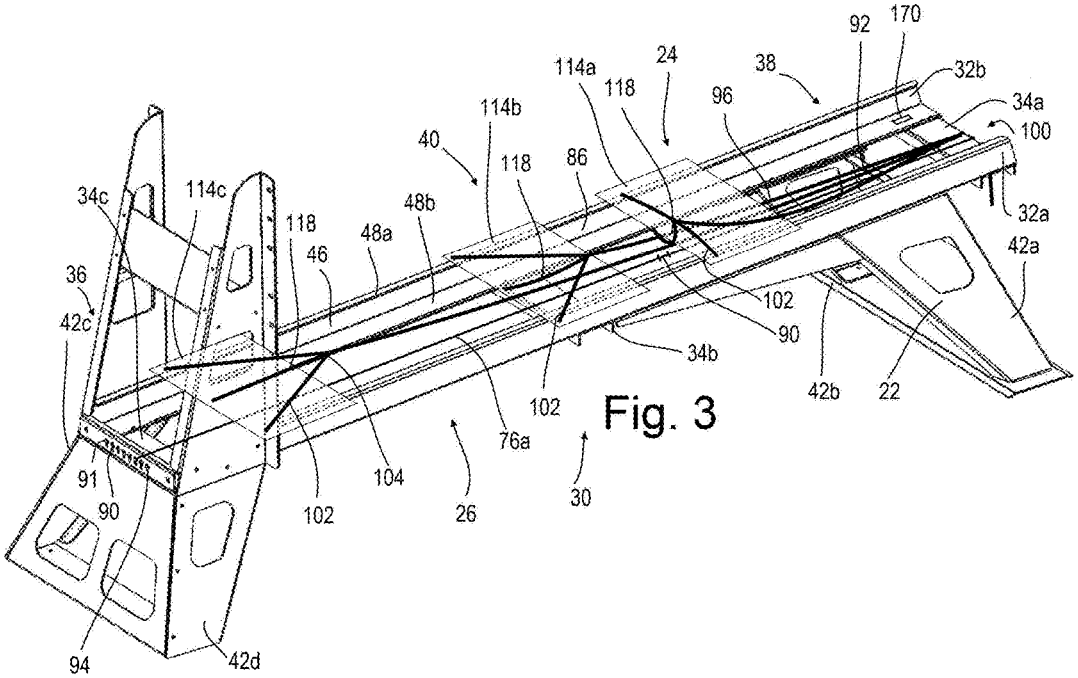
FIG. 3 is a side isometric view of a support frame sub assembly of the example shown in FIG. 1.

As shown in FIG. 3, the support frame 22 comprises in one form two longitudinally extending frame members 32*a* and 32*b*. The frame members 32*a* and 32*b* of this example are connected by way of cross members 34*a*, 34*b*, and 34*c*. The frame 22 as shown has a foot end 36, a head end 38 and a central region 40. In this example, there are three cross members 34 (*a-c*) employed where the cross member 34*c* is positioned at the foot end 36 of the frame 22 and the cross member 34*a* is positioned at the head end 38 of the frame 22. A plurality of legs 42*a*, 42*b*, 42*c*, and 42*d* may be utilized to support the frame members 32*a* and 32*b* above a floor 44 (see FIG. 1).

Looking to FIG. 3, it can be seen how the frame members 32*a* and 32*b* are formed in this example. As shown in this example, each frame member 32 (*a-b*) may have a vertically orientated portion 46 and horizontally extending, vertically offset portions 48*a* and 48*b*.

As described further herein, each frame member 22 supports and holds wheels 50 of the carriage 24 to maintain the carriage 24 movably positioned upon the frame 22. In this arrangement, the offset portion 48*a* prohibits upward movement of the wheels 50 relative to the frame 22, and the offset portion 48*b* prohibits downward movement of the wheels 50 relative to the frame 22. A stopper member 170 may be provided at the head end 38 of the frame 22 to prevent the carriage from longitudinally moving past the head end 38 of the frame 22.

The carriage 24 is movably positioned in a longitudinal direction relative to the frame 22. The carriage 24 of this example as shown in FIG. 1 is provided with a base member 52 having an upper surface 54 that is adapted to support a patient thereon. In this example, a back rest 56 is attached to the base member 52 to provide padding to conform to the contour of the lower back or other body part of a participant lying or otherwise supported by the carriage 24. There are numerous orientations an individual can be positioned upon this base member 52, including a sideways orientation where the patient's hips engage the back rest 56, or a downward facing, kneeling like stance where the participant's knees would engage the back rest 56 for comfort and proper support. As further shown the base member 52 can be provided with a removable, sliding, repositionable, or pivoting shoulder rest 58 attached by way of a transversely oriented pivot 60 to the base member 52. The shoulder rest 58 may also utilize an adjustable headrest 62 positioning system which in one form comprises a hook and loop, snap, strap, or equivalent fastening system. In one example, hook and loop fasteners are attached to an upper surface of the shoulder rest 58 and to a lower surface of the headrest 62 thus positionably attaching the headrest 62 to the shoulder rest 58 or back rest 56. Referring to FIG. 3, the headrest 62 is shown with a forward surface 64 adapter to receive force from the exercise participant.

Figure 2:
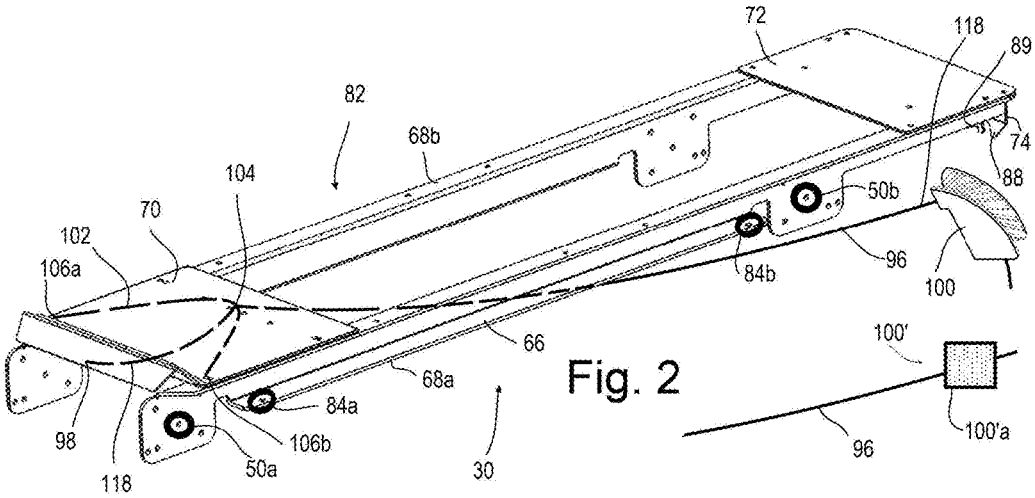
FIG. 2 is a side isometric view of a carriage frame sub assembly of the example shown in FIG. 1.

FIG. 2 shows one example of a carriage frame 66 showing a lower portion of the carriage 24 with the base member 52 and other components removed to show the underlying components of the frame. In one form, the base member 52 is removable from the carriage frame 66 for maintenance and cleaning.

In one example the carriage frame 66 comprises first longitudinal frame member 68*a* and second longitudinal carriage frame member and 68*b*. When assembled, the longitudinal carriage frame members 68*a* and 68*b* are positioned laterally inward from the frame members 32*a* and 32*b* previously described. These frame members may be connected by one or more laterally extending members such as a foot rest plate 70, rearward cross plate 72, and resistance system engagement plate 74 which may be integral to the rearward cross plate 72. The resistance system engagement plate 74 is utilized to engage the resistance system 26 for application of elastic members 76 attached thereto.

In one form, positioned laterally outwardly from the back rest 56 are first and second guide bars 78*a* and 78*b*. User support handles 80*a* and 80*b* are optionally attached thereto and can be rotated between an upward pointing orientation as shown in FIG. 1, downward pointing orientation, or in an outward pointing orientation. The user support handles 80 are provided for grasping by the participant-patient. The handles 80 of one example may also be repositioned longitudinally along the guide bars 78.

In one form, a mobility system 82 comprises the plurality of vertically rotating weight bearing wheels 50 (*a-d*) and a plurality of horizontally rotating lateral wheels 84 (*a-d*) (two of each not visible in FIG. 2 are mirror images of those shown). The mobility system 82 cooperates with the frame 22 in that the wheels 84 are adapted to engage the inner surface 86 or vertical portion 46 of the frame 22 to reduce friction, prohibit removal, and allow longitudinal repositioning of the carriage 24 relative to the frame 22. As they rotate, the upper surface of the horizontally extending wheels 84 (*a-d*) engage inner surfaces 86 of the horizontal portions 48*a* and 48*b* to ensure smooth operation of the device. This arrangement substantially prevents an excessive amount of rotation of the carriage 24 about a vertical axis relative to the frame 22 when the device is operated. It is normally desired to have a minimal amount of "rattling", undesirable friction, or lateral movement of the carriage 24 relative to the frame 22. The horizontally extending wheels 84 may be arranged and installed with a slight interference fit to put a slight outward pressure against the inner surface 86 of the frame 22.

The upper surface of the vertically rotating wheels 50 may engage the lower or inner surface of the horizontal portion 48*a* of the frame members 32 in the presence of a vertical force upon the carriage 22. These horizontal portions 48*a* and 48*b* prevent the carriage 24 from lifting, falling, or otherwise being vertically separated from the frame 22.

In one form the resistance system includes an attachment system as seen in FIG. 2 where the resistance system engagement plate 74 comprises surfaces 88 defining a plurality of slots 88 providing an attachment for stops 90 attached to elastic members 76. In one form these slots 88 are vertically extending. In one example, the lateral positioning of the slots at least partially correlates with the orientation of the elastic members 76 attached at 94 to the foot end 36 of frame 22. Between the slots are fingers or extension members 89 which may have a slight longitudinal headward extension to more properly engage the stop(s) 90 of the elastic members 76. This attachment system provides a convenient attachment location for the stops 90 of one or more elastic members 76 of the resistance system for providing selective resistance of the carriage 24 in a longitudinal direction with respect to the frame 22 by adjusting the number, operational length, or individual resistance of the elastic members 76 engaging surfaces 91 equivalent to the surfaces 88 previously described.

The cross member 34*a* in one form provides an anchor point for attachment of a control cord 92 which need not be elastic.

The resistance system 26 operates to provide an adjustable amount of resistance between the carriage 24 and the frame 22 in a longitudinal direction. It is desirable to have a user-friendly, accessible resistance system 26 for adjusting the amount of resistance applied to the carriage 24. One example of a similar resistance system 26 is disclosed in U.S. Pat. No. 7,682,297 incorporated herein by reference.

The resistance system 26 of one example is comprised of a plurality of the elastic members 76 attached at one end 94 to the foot end 36 frame 22 optionally at surfaces 91. For convenience purposes each of the members as described herein will be described with the numeral 76 with the identifier "a", "b", etc. following the numeric identifier. As previously described, the surfaces 91 defining the vertically aligned slots are configured to engage the stops 90 of the elastic members 76. It should be noted that the term elastic member is defined broadly for any type of member that resists expansion from a one length to another, either compressive or in tension. In one form, the elastic members are comprised of a conventional bungee cord type material; in other forms various forms of helical springs or the like can be utilized. Further, if the elastic members 76 comprise loop portions, the loop portion could engage for example vertically downward extending portion i.e. 89 between two adjacent slots 91 or 88.

It may be desirable to have the elastic member 76 and more particularly the control cord 92 easily reached when in the non-engaged position (not attached to the frame) so the therapist adjusting the tension can more readily grasp or control the central portion of the control cord 76 and reposition the elastic member 76 upward to an engaged orientation where the stop 90 is attached to engagement plate 74 or cross member 34*c*. A similar attachment system is disclosed in U.S. Pat. No. 6,831,122 incorporated herein by reference.

The range of motion control system 30 disclosed herein effectively limits the range of travel of the carriage 24 with respect to the support frame 22 towards the kick plate 28 and may provide a soft stop as the carriage 24 moves in the footward direction. In this example of FIG. 2, the range of motion limiting system 30 comprises an adjustment cord 96 attached at one end 98 to the carriage 24 and adjustably attached at the opposing end to the frame 22 at fixing member 100. One such fixing member is disclosed in U.S. Pat. No. 3,574,900 incorporated by reference. The effective length of the adjustment cord 96 may be controlled by adjusting the length of the adjustment cord between the attachment point 98 and the fixing member 100. When using a jam-style cleat as shown in the example of FIG. 3, the adjustment cord 96 may be cleated at an unlimited number of positions to fixing member 100 as desired.

An elastic member 102 may be fixed to the carriage such that when the carriage 24 moves toward the foot end 36 of the carriage 36, the distance from the fixing member 100 to the attachment point 98 increases. In this example the elastic member 102 is fixed to the control cord 92 at connection point 104 between the fixing member 100 and the attachment point 98 such that the elastic member 102 will be engaged/tensioned prior to tensioning of the portion 118 of the control cord 96 between the fixing member 100 and the connection point 104, thus providing increasing resistance opposing the motion of the carriage 24 in the longitudinally foot ward direction. In other words, as the tension in the elastic member 102 increases, the elastic member 102 will elastically pull on the control cord 92. Therefore, it can be appreciated that in one form the range of motion control system 30 will resist motion of the carriage 24 with respect to the frame 22 toward the foot end 36.

Figure 5:
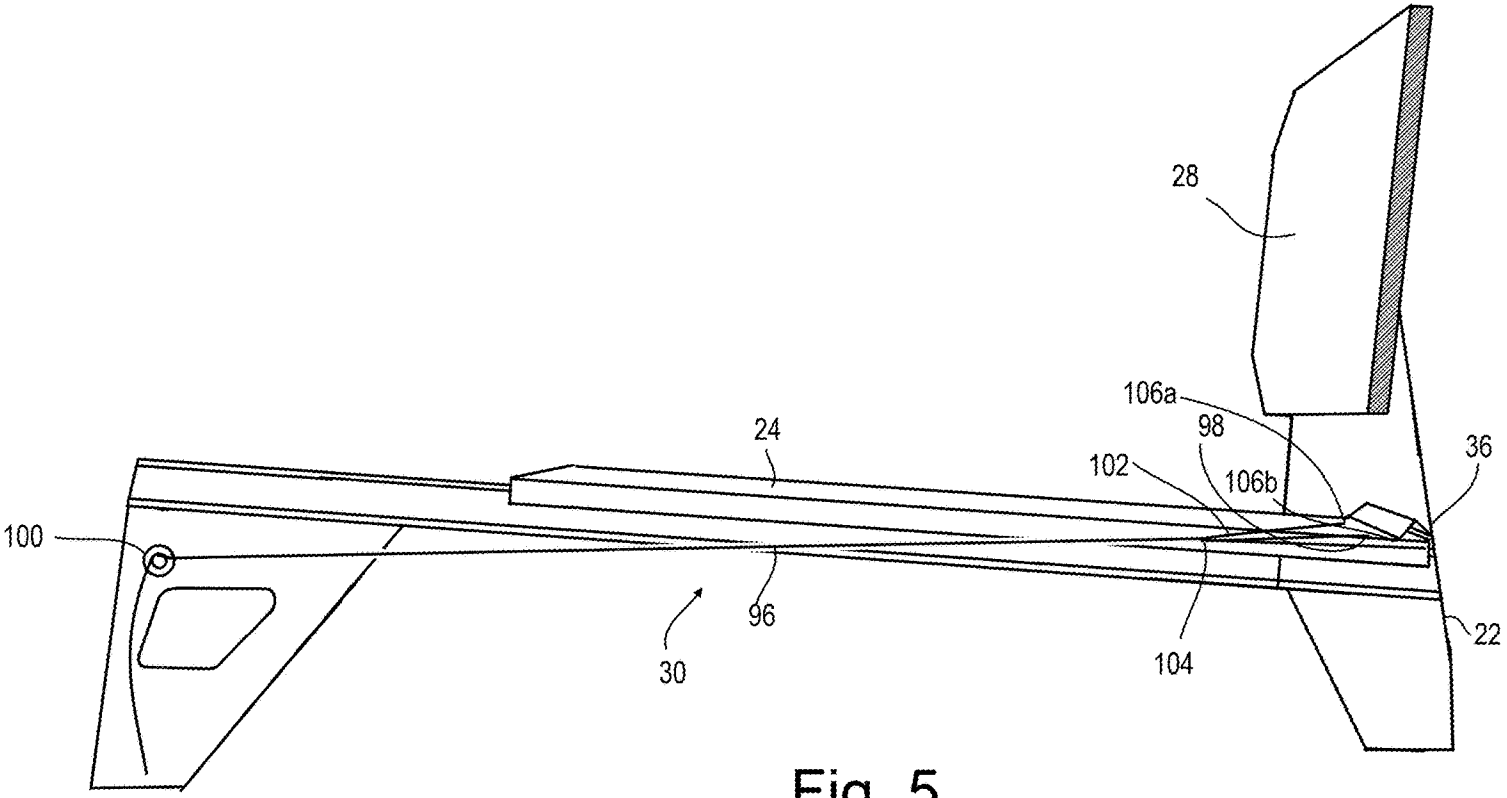
FIG. 5 is a highly schematic side cutaway view of the example shown in FIG. 1 with the carriage frame sub assembly in a second position.

As the carriage 24 continues to move toward the foot end 36 as shown in FIG. 5, the carriage 24 will be stopped by the adjustment cord 96 as the distance between the fixing member 100 and the attachment point 98 reaches the effective length of the adjustment cord between the fixing member 100 and the attachment point 98, drawing the adjustment cord 96 taught. The adjustment cord may 96 may be slightly elastic, less elastic than other members, or non-elastic within the force ranges experienced by operation of the device.

FIG. 3 shows a highly schematic representation of the carriage 24 in a headward position 114*a* away from the foot end 36 where the adjustment cord 96*a* is loose. As the carriage 24 moves toward the footward end 36 to the position 114*b*, the elastic member 102 and adjustment cord 96 between connection 104 and fixing member 100 will tension. As the carriage continues to move toward the footward end 36, the elastic member 102 may continue to stretch until the carriage 24 reaches the position 114*c* where the substantially non-elastic section 116 of the adjustment cord 96 is taught, and the carriage 24 is prohibited from further footward movement by the substantially non-elastic adjustment cord 96 in tension. This range of motion control system 30 effectively limits the range of travel of the carriage with respect to the frame towards the kick plate 28 and provides a soft stop to the carriage in the footward direction at a desired location which can be adjusted by repositioning the adjustment cord 96 in the fixing member 100.

The fixing member 100 may alternatively be a hook and loop like attachment mechanism 100' with one portion 100'*a* on the adjustment cord 96 and the other portion 100'*b* attached to the frame 22.

Figure 4:
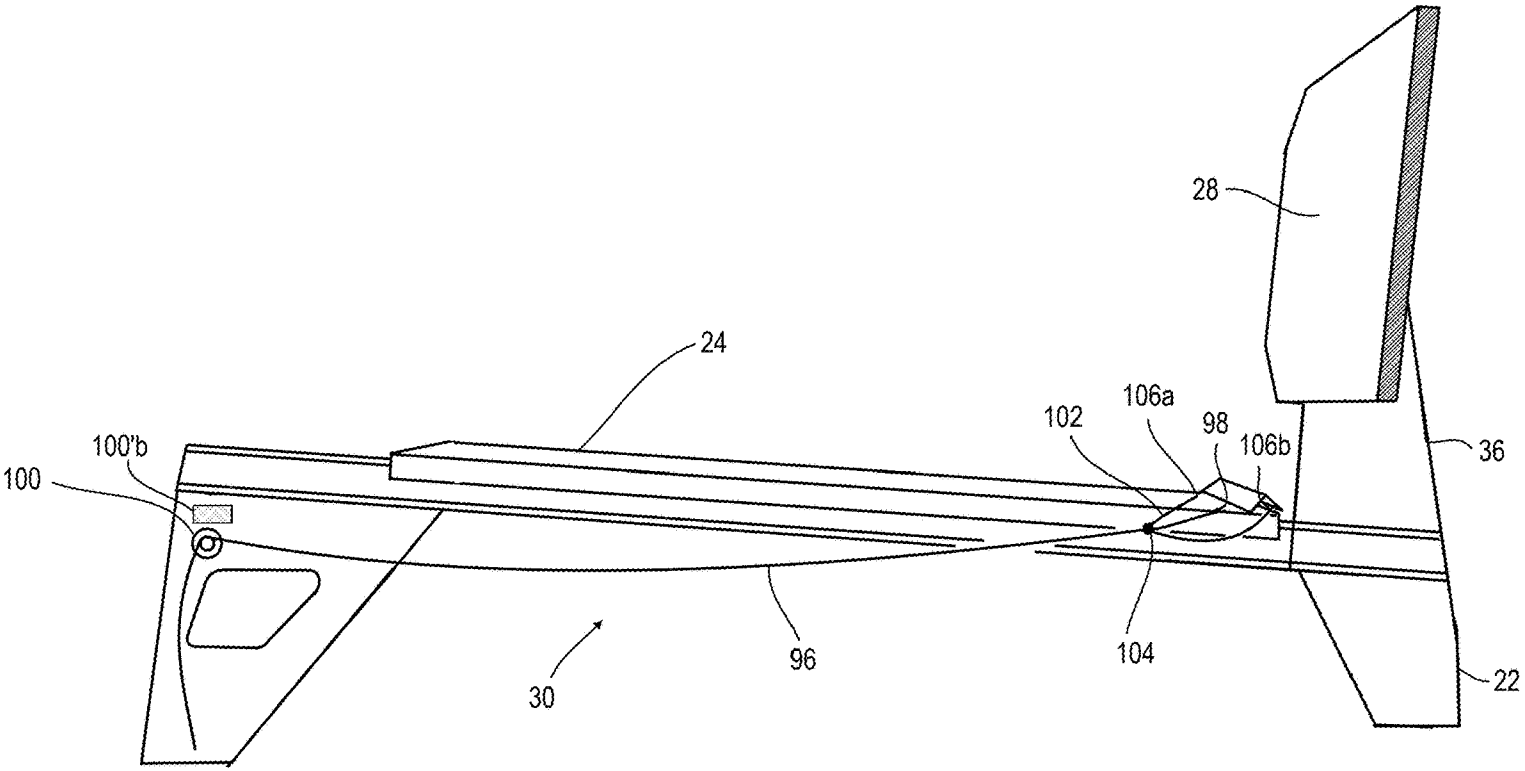
FIG. 4 is a highly schematic side cutaway view of the example shown in FIG. 1 with the carriage frame sub assembly in a first position.

In the example shown in FIG. 4, the elastic member 102 comprises a length of elastic material such as a length of rubber tubing attached at either end 106*a*, 106*b* to the carriage 24 and connected at a middle region at connection point 104 to the adjustment cord 96.

The carriage 24 is shown in FIG. 1 sliding on the frame 22 at an incline angle 108 to the floor 44, where the foot end 36 is substantially lower than the head end 38 of the frame 22. In this arrangement, the user may be at a much more comfortable position, and additionally, the inclination 108 may provide for additional resiliency during treatment.

Looking to FIG. 1, the handles 80 are shown pivotably attached to the guide bar 78 to be easily grasped or rotated out of the way. In one form, an end knob 110 is rigidly coupled to the extension 112 and threadedly engaged within an end slider, which is operably configured to slide longitudinally along the cylindrical guide bar 78 when released. When the end knob 110 and extension 112 are rotated, tension is released relative to the guide bar 78, such that each handle 80 is permitted to slide longitudinally along the guide bar 78 and may also be permitted to rotate thereabout.

As it is often desired to lock the carriage 24 in relative position to the frame 22, a plurality of extensions 172 may extend laterally from the frame 22. When it is desired to lock the carriage 24 relative to the frame 22, a handle 80 may be released, longitudinally positioned, and simultaneously rotated to fit between the extensions 172 and positioned therebetween while tension is provided between the handle 80 and guide bar 78, such that the handle 78 is temporarily fixed relative to the guide bar 78. This can be accomplished either by substantially tensioning the handle 80 and then rotating it about the guide bar 78 to fit between the extensions, or alternately to position the handle 80 prior to tensioning. The handles 80 are generally provided on both lateral sides of the carriage 24. In practice, a participant may desire to have multiple extensions provided along the frame 22 for even more adjustability; however, it has been found that a single extension pair positioned near the longitudinal centerline of the frame 22 is normally sufficient.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A shuttle training and therapy device comprising:

a frame having a headward end and a footward end;

a carriage attached to the frame so as to longitudinally reposition relative thereto;

a range of motion limiting system consisting essentially of a nonelastic control cord having a substantially non-elastic effective length defined by a first end of the non-elastic control cord attached to the carriage, a second end selectively attached to a fixing member attached to the frame, and an intermediate portion attached to an elastic member at an intermediate point;

the elastic member having a first end attached to the carriage;

wherein a portion of the non-elastic control cord extends between the intermediate point and the carriage;

wherein the elastic member is configured to be tensioned between the carriage and the intermediate point prior to tensioning of the portion of the substantially non-elastic control cord between the intermediate point and the carriage; and the range of motion limiting system configured such that movement of the carriage toward the footward end of the frame will be stopped by the non-elastic control cord as a distance between the fixing member and the second connection point reaches the non-elastic effective length of the non-elastic control cord, drawing the non-elastic control cord taught.

2. The shuttle training and therapy device as recited in claim 1 wherein a length of the control cord between the first end and second end is adjustable.

3. The shuttle training and therapy device as recited in claim 2 wherein the control cord comprises a hook and loop system attached thereto such that the hook and loop system positionably attaches the control cord to the headward end of the frame.

4. The shuttle training and therapy device as recited in claim 1 wherein the carriage positioned on the frame at an incline angle to a floor upon which the frame rests, wherein the footward end of the frame is vertically lower than the headward end of the frame.

5. The shuttle training and therapy device as recited in claim 1 wherein the elastic member is attached at either end to the carriage and connected at a middle region to the control cord.

* * * * *